United States Patent [19]

Meyer

[11] 3,955,798

[45] May 11, 1976

[54] GUIDING AND POSITIONING DEVICE FOR THE BLOCK AND HOOK OF A DERRICK ON A SHIP

[75] Inventor: Andre Meyer, Chatenay-Malabry, France

[73] Assignee: Groupement pour les Activities Atomiques et Avancees "GAAA", Le Plessis-Robinson, France

[22] Filed: Nov. 28, 1973

[21] Appl. No.: 419,838

Related U.S. Application Data

[63] Continuation-in-part of Ser. No. 256,899, May 25, 1972, abandoned.

[52] U.S. Cl. ..... 254/139; 254/188

[51] Int. Cl. ..... B66c 23/60

[58] Field of Search ..... 254/139, 139.1, 188; 187/8.72; 214/DIG. 10; 175/27; 116/.5

[56] References Cited

UNITED STATES PATENTS

| | | | |
|---|---|---|---|
| 2,201,147 | 5/1940 | Bury et al. | 187/8.72 |
| 2,480,916 | 9/1949 | Gibson | 187/8.72 |
| 2,928,558 | 3/1960 | Bamford | 187/8.72 |
| 3,228,659 | 1/1966 | Sturm | 187/8.72 |
| 3,507,405 | 4/1970 | Jones et al. | 254/139.1 |
| 3,526,425 | 9/1970 | Langowski et al. | 254/139 |

*Primary Examiner*—Robert J. Spar
*Assistant Examiner*—Kenneth Noland
*Attorney, Agent, or Firm*—Sughrue, Rothwell, Mion, Zinn & Macpeak

[57] ABSTRACT

Improved guiding and positioning device for the block and hook of a derrick installed on board a ship, enabling dual speed boring, which, as an assembly formed by the block and the hook, is connected to a carriage sliding on two rails parallel to the axis of the well by two indentical mechanisms ensuring horizontal linear movement of the block and the hook.

3 Claims, 4 Drawing Figures

Figure 1:
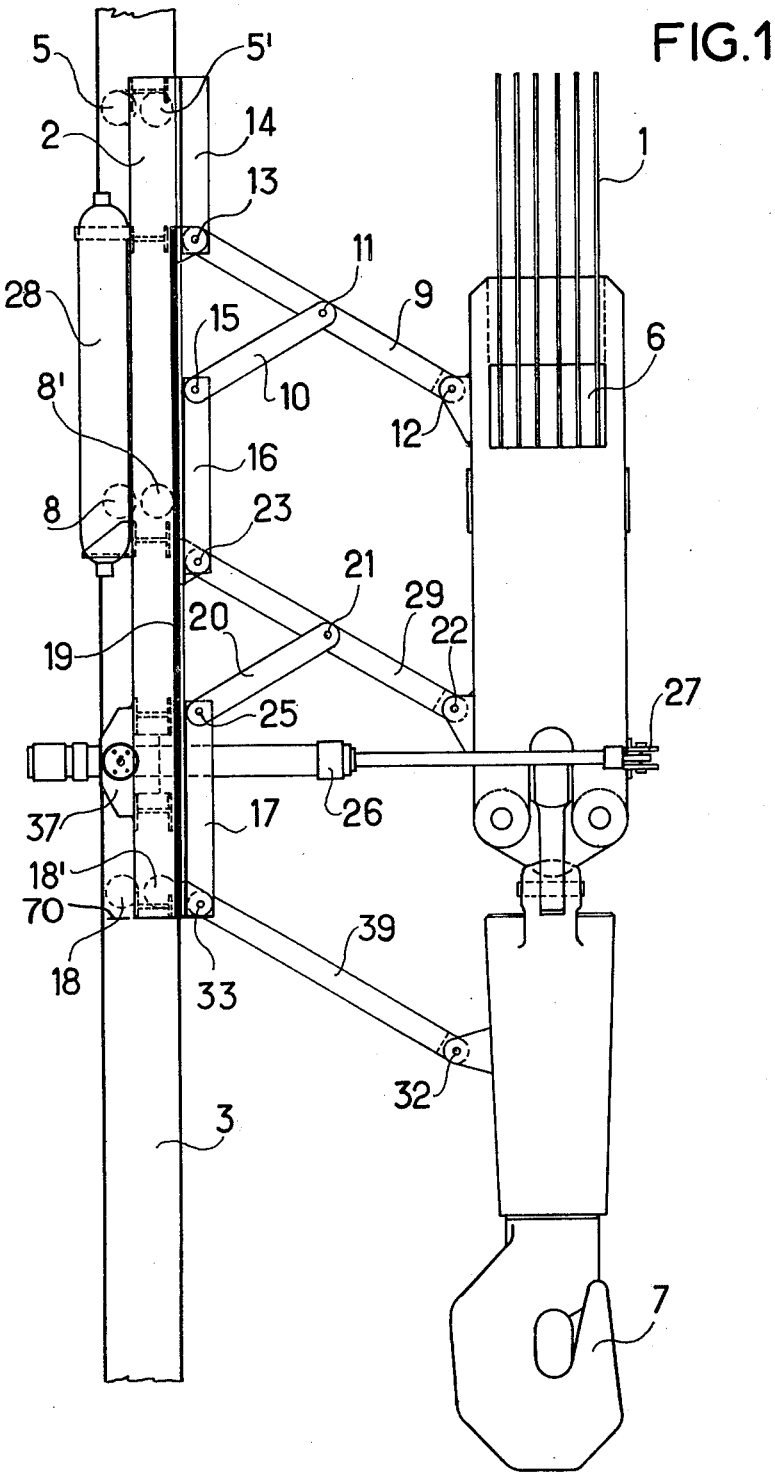

5
5'
2
14
13
1
11
28
9
15
6
8'
10
12
16
8
23
21
29
20
22
19
27
25
37
17
26
18'
70
39
18
33
32
3
7

GUIDING AND POSITIONING DEVICE FOR THE BLOCK AND HOOK OF A DERRICK ON A SHIP

This application is a continuation-in-part of application Ser. No. 256,899 filed May 25, 1972 and now abandoned.

The present invention relates to a device which may advantageously be installed in a derrick on board a ship for guiding and maintaining the tackle-block and the hook of the drilling train during the various drilling and handling operations.

It is known that in operations involving drilling at sea by means of a derrick on board a ship, it is accepted practice to guide the tackle-block and the hook during their displacement in the derrick, so as to prevent the swell and the wind from giving rise to untimely movements. Since drilling at sea is extremely costly, it is desirable to continue to work even if the swell is relatively strong. Thus, any device which will make it possible to improve the guiding of the masses which tend to oscillate due to the swell constitutes a highly acceptable improvement. Additionally, it is clear that, when drilling at sea it is particularly desirable to avoid any kind of waste of time and to operate by "dual speed" methods i.e., for example, during an operation for demounting a drilling train, to release the tubes constituting the drill, during the descent of the tackle-block. Thus, designers have been induced to impart to the tackle-block and to the hook two separate rectilinear travel paths, one perpendicular to the well and the other offset relative to this axis so as to free the space above the well.

It is known to the persons skilled in the art to provide a device comprising an approximately vertical guide rail the axis of which is offset from the axis of the derrick well and on which circulates a "truck" or carriage connected by a connecting means to the tackle-block and to the hook and permitting them to occupy any useful position both in the axis of the derrick and also on a vertical line near the guide rail. The various designs known to the Applicants differ, however, from each other due to the mode of connection provided between the truck and the assembly comprising the hook and the tackle-block. Furthermore, it is obviously possible to dispose the means for displacing these elements or members either on the truck or on the connecting means, or on the tackle-block. Similarly, the movement may be controlled either by an electric motor or by hydraulic or pneumatic means.

One of the systems known at the present day for displacing the assembly comprising the tackle-block and the hook is constituted by a predetermined number of connecting links forming deformable parallelograms.

The displacement of the tackle-block and hook assembly out of the axis of the well towards an offset position requires, in this device, the upward transfer of the truck relative to the tackle-block and the hook, thus giving rise to a certain consumption of the energy which is perfectly unnecessary. Such a design thus makes it necessary to give the drive means an excessive amount of power, and thus to increase volume and mass in an unnecessary and detrimental fashion, all the more since the power which it is necessary to provide is as a rule relatively great, since all these operations must, in any case, be carried into effect in the shortest possible time. This increase in the mass of the drive means is proportionally detrimental in as much as the said means are as a rule installed at least partially on moving elements.

The fundamental idea of the present invention is thus to limit to the strict minimum the power necessary for effecting the transfer of the tackle-block and hook assembly from one position to the other, whilst, at the same time, producing movements on which the influence of accelerations due to the swell, to rolling or lurching, to pitching and to the wind, is diminished to the maximum possible extent.

The invention relates to an improved device installed in a derrick on board a ship and making it possible, despite the swell, to guide and maintain the tackle-block and the hook either along the axis of the derrick or along a direction parallel thereto, and offset through a predetermined distance, the said device comprising two guide rails which are very substantially parallel to the axis of the derrick and offset relative to the latter, a truck or carriage displaced along guide rails, means for connection between the tackle-block and the hook assembly and the truck, characterised in that the said connecting means permit the hook and the tackle-block to be displaced relative to the truck with a predetermined degree of freedom, in a direction very substantially perpendicular to the guide rails.

The achievement of such a condition makes it possible to reduce to the minimum the energy necessary for the displacement of the tackle-block and the hook out of the axis of the well towards an offset position since such displacements are effected in a very substantially horizontal plane. On the other hand, the said displacement may then be effected at a speed which is very much higher than that in the known system. Whereas, in general, the movement of translation of the assembly constituted by the tackle-block and the hook necessitates a considerable proportion of the time required for hoisting the tackle-block towards the top of the derrick, the same movement of translation may be effected due to the device proposed by the Applicants in a time which is so short that the tackle-block and the hook remain substantially at the same height. The person skilled in the art will readily appreciate the profit which may be derived from an improvement of this kind.

Finally, it is no longer necessary to over-dimension the means for driving the tackle-block and the hook.

Horizontal displacement of the tackle-block and of the hook relative to the truck is obtained by imparting a predetermined geometry to the connecting means.

Thus, the invention also relates to an improved device installed in a derrick on board a ship, according to the description given hereinabove, wherein the connecting means consists of two interconnected assemblies for symmetrical positioning and guiding relative to a plane containing the axis of the drilling well and the mediatrix of the two rails, each assembly comprising, notably, link rods one end of which carries a roller or wheel adapted to slide along the track, characterised in that two of the link rods of each guiding and positioning assembly and furthermore connected to the truck through the agency of an end of a link the other end of which is secured to the centre of the link rod, and the length of which is equal to half the length of the link rod.

The result of this arrangement is that the centre of the link describes, relative to the truck, an arc of a circle, the radius of which is equal to half the length of the said link. Furthermore, in view of the fact that the end of the link contacting the truck travels by sliding along a straight surface fast with the truck, it will be appreciated that the other end of the link describes a straight line perpendicular to the direction of the rail.

Thus, it suffices to establish, starting from one rail, two articulated connections such as those described hereinabove, in order to obtain a movement of displacement of the tackle-block or of the hook perpendicular to the direction of the rails. On the other hand, it is necessary to employ three connecting means of this type in order to obtain a simultaneous horizontal displacement of the tackle-block and the hook. In the third connecting means, the stress imposed by the link may advantageously be obtained by connecting the end of the third link-rod carrying the sliding-motion roller to the homologeous ends of the two further link-rods. A third link is then unnecessary.

The existence of the two interconnected assemblies, both attached to the truck and disposed symmetrically relative to a plane containing the axis of the well and the mediatrix of the two rails, makes it possible to ensure transverse rigidity of the assembly and to render the displacements thereof insensitive to the action or the swell of the wind and to the accelerations therefrom.

Figure 2:
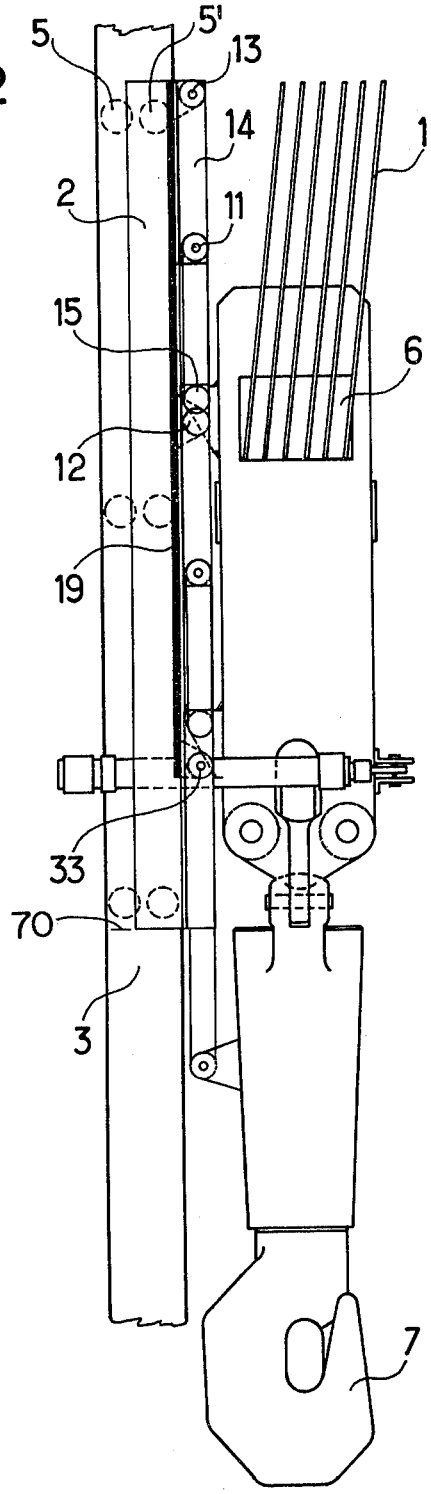
Figure 3:
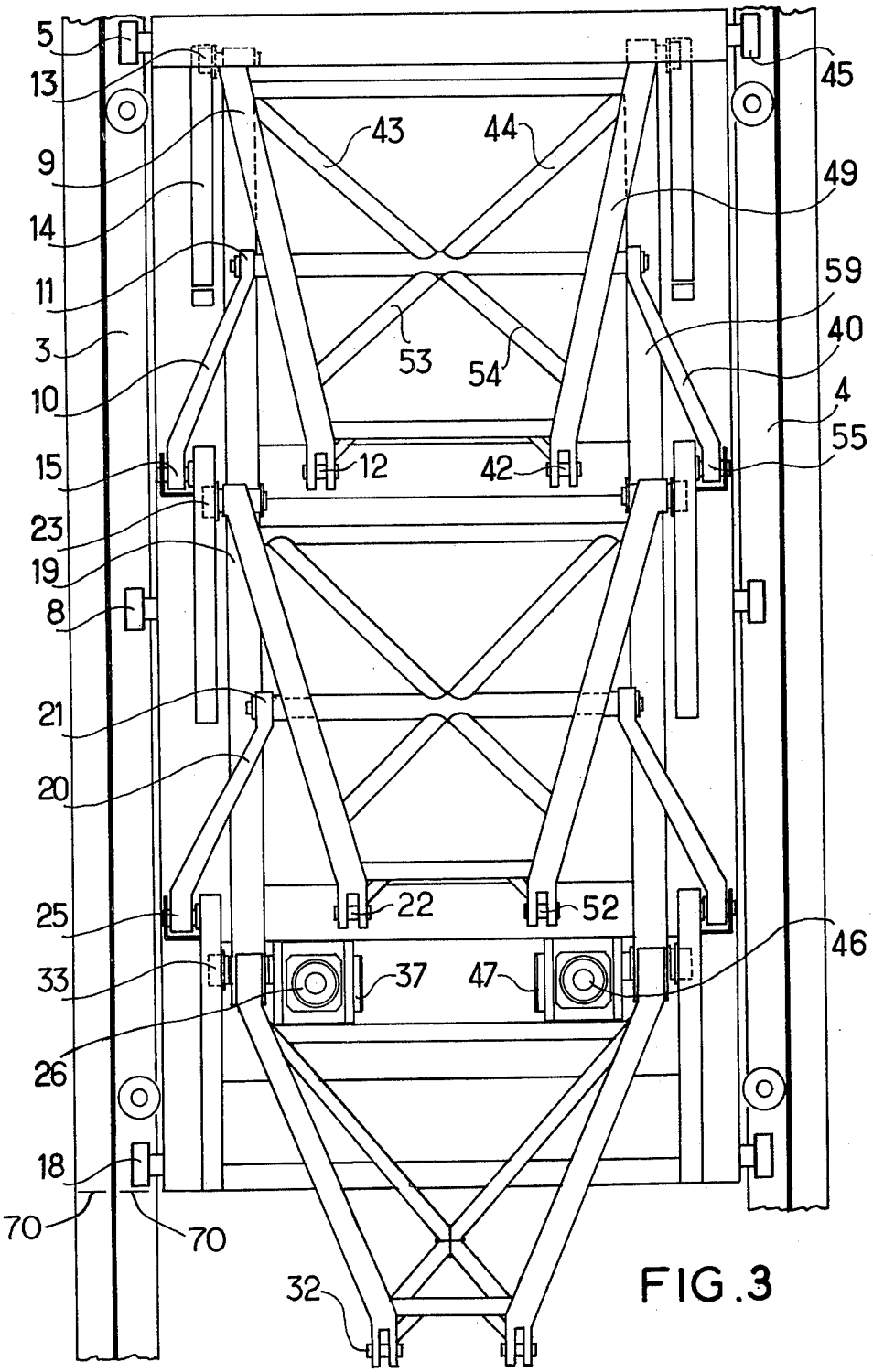
Figure 4:
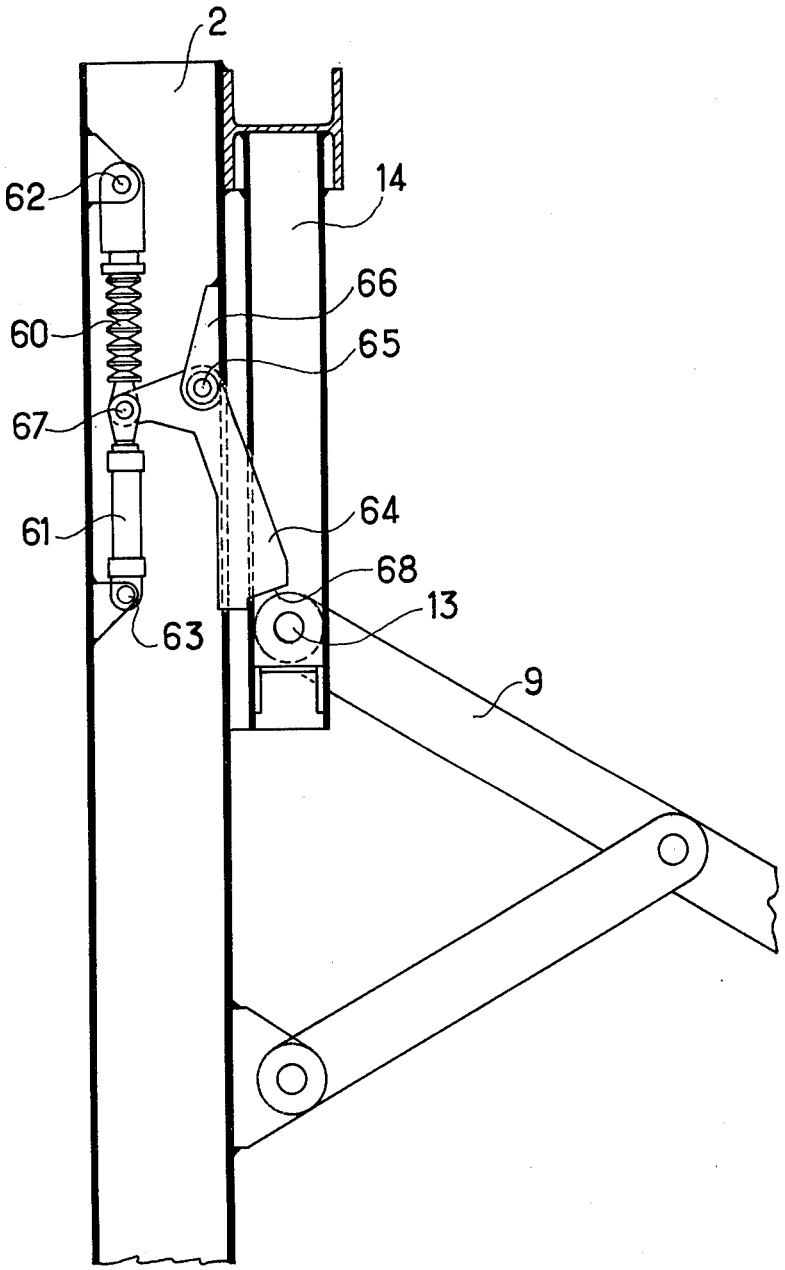

The invention will be better understood on reading the description hereinbelow and on examining the four accompanying Figures showing, purely by way of non-limitative example, an embodiment of such a device for the guiding and positioning of the tackle-block and the hook in a derrick on board ship, and in which:

FIG. 1 shows a profile view of an embodiment of mechanism according to the invention, illustrating more clearly the essential features of the invention, FIG. 2 shows the same profile view, when the tackle-block and the hook are offset from the axis of the derrick and the mechanism is retracted, FIG. 3 is a front view of the same embodiment, FIG. 4 shows the mode of locking the device according to the invention.

Referring to FIG. 1, which illustrates an embodiment by way of example, 2 designates a truck or carriage 2 mounted on a rail 3 and adapted to travel on the said rail 3 due to rollers or wheels 5,8 and 18 and counter rollers 5',8' and 18'. Rearwardly of the plane of the Figure is a second rail 4 on which is disposed a mechanism identical with the mechanism shown in FIG. 1 — shown in the front view of FIG. 3.

At a predetermined distance at right angles to the rail and perpendicular to the well (in the axis of the derrick) is the tackle-block 6 and its hook 7 supported by the cable 1 extending into the tackle-block.

The assembly constituted by the tackle-block and the hook is connected to the truck or carriage 2 by links 9,29 and 39 connected to the suspended mass by articulation means 12,22 and 32 respectively, each comprising an axis perpendicular to the plane of the Figure under discussion. The other end of the link 9 is free to slide due to a roller or wheel 13 in a slideway 14 connected to the truck or carriage. The same applies to the links 29 and 39, the respective ends 23 and 33 of which are provided with rollers adapted to travel in the slideways 16 and 17 fast like the slideway 14, with the carriage 2. The three ends 13,23 and 33 of the three links 19,29 and 39 are free to slide on their respective slideways 14,16 and 17 and are secured by means of a beam 19. The result of this arrangement is that the three links 9,29 and 39 constitute, with the assembly of the tackle-block and hook and also with the carriage rail, three deformable parallelograms.

When the tackle-block and its hook approach the rail, the rollers connected to the points 13,23 and 33 slide along their slideways 14,16 and 17 so that the links would be able to adopt, during this movement, a variable angle relative to the horizontal without thereby driving the carriage. In order to obtain, in every case, a horizontal movement relative to the carriage and to diminish accordingly the magnitude of the force which any motor will require to supply to put the tackle-block and its hook in contact with the carriage, the Applicants envisaged completing the mechanism by adding links such as 10. The said link is articulated by a pivot 11 to the centre of the link rod 9 and, on the other hand, it is fixedly secured to the carrage also by means of articulation means 15 provided with an axis of rotation perpendicular to the plane of the Figure so that when the point 12 of the tackle-block approaches the rail 3, the point 13 slides on the slideway 14, whereas the point 11 is displaced on a circle having a centre 15 and a radius of which is equal to half the length of the link rod 9. Thus, it will be clear that the straight line joining the point 12 to the point 15 is perpendicular to the direction of the rail. Thus the point 12 describes a horizontal line.

To the centre 21 of the link rod 29 there is articulated a link 20 the length of which is equal to half that of the link rod 29 and the other end of which is articulated at a fixed point 25. The point 22 is then also subjected to a horizontal displacement. Two of its points (12 and 22) are displaced horizontally, so that the tackle-block is displaced horizontally. The connection established due to the beam 19 compels the roller 33 to slide simultaneously with the rollers 23 and 13 along the slideway 17. The point 32 of the hook 7 and the connection of the hook with the tackle-block are displaced horizontally and the same applies to the hook itself.

The relative displacement of the hook and of the tackle block with respect to the carriage 2 is controlled by an hydraulic jack 26 connected to the tackle-block by means of articulation means 27 the vertical axis of which is parallel to the plane of the Figure. The jack is also provided with an articulation flange or cheek 37 connected to the carriage 2. Reference numeral 28 designates an hydraulic accumulator connected to the jack by ducting and an electromagnetic valve (not shown) permitting the injection into the jack of the full pressure in order to bring about the movement of translation of the tackle-block and of the hook at high speed. The hydraulic accumulator fast with the carriage is charged by a motor-pump (not shown) which may advantageously also be connected to the carriage, in view of its moderate bulk.

It is self-evident that the mechanism comprises furthermore a second jack 46 (not shown in this Figure) but which is shown in the front view (FIG. 3).

FIG. 2 shows the mechanism in the retracted position; the Figure shows the roller 5 and its counter roller 5' causing the carriage 2 to slide on the rail 3. The sliding roller 13 has reached the end of the slideway 14 connected to the carriage. The centre 11 of the link rod 9 has ascended to point 13 whereas the articulation means 15 connected to the carriage has not moved. The articulation means 12 of the link rod and of the hook has been superposed on point 15. The same displacement takes place at the ends of the further link rods, whereas the beam 19 has been displaced upwardly by a distance equal to the sliding of the rollers 13,23 and 33. The translation of the tackle-block and of the hook relative to the carriage is horizontal so that it is equal to the travel of the jack when the latter is also connected to the carriage.

FIG. 3 shows a front view of the mechanism in the folded position. Thus, (as in FIG. 2) the link rod 9 is applied along the carriage and the roller 13 is disposed at the upper portion of the slideway 14. The perfectly symmetrical structure of the mechanism as a whole will also be noted. It will be seen that there corresponds to the travel roller 5, bearing on the rail 3, a roller 45 bearing on the rail 4. To the link rod 9 corresponds the link rod 49 and to link 10 corresponds to the link 40; to the fixed articulation means 15 corresponds the symmetrical articulation means 55.

It will also be noted that the tackle-block is retained at one side by the articulation means 12 and 22 and at the other side by the symmetrical articulation means 42 and 52. To the beam 19 which associates the movements of the displacement of the rollers 13,23 and 33 corresponds a beam 59 fulfilling analogous functions. It will be noted that throughout the structure it has been endeavoured to achieve a degree of symmetry which will more readily maintain the oscillating mass during movements produced by the swell and the wind.

Similarly, the wind-bracing of the symmetrical members is effected by symmetrical braces such as the elements 43 and 44 or 53 and 54. At 26 there is shown the jack and at 37 its articulation flange. The same elements are to be found on the symmetrical jack 46 the articulation flange or cheek of which is shown at 47.

FIG. 4 shows a detail of a locking system permitting the immobilisation relative to the carriage of the mechanism in the open position above the well or shaft. It comprises, essentially a spring 60 and an opposing jack 61 secured to the carriage 2 by the pivot 62 and 63 respectively. The latching means 64 pivots about its pivot 65 connected to the carriage by a connecting member 66. Furthermore, the latching means is fast with the common end 67 of a spring 60 and of the jack 61.

A flat 68 on the latching means 64 bears on the roller 13 of the link rod 9 when the latter is in the open position. The beam 19 then simultaneously locks the rollers 23 and 33 and the link rods 29 and 39 remain in the open position. The latch is maintained in the open position due to the action of the spring 60.

Locking in the open position is thus mechanical. Unlocking is effected by an hydraulic drive. Under the action of the jack 61 the pivot 67 ascends, the latch pivots about the pivot 65, the effect thereof being to free the roller 13 which no longer bears on the flat 68 of the latch 64 and is able to ascend freely along the slidway 14.

In view of the fact that the tackle-block is displaced horizontally in a direction perpendicular relative to the vertical plane of the carriage 2 there will be no vertical translation of the carriage whatsoever so that the vertical position of the carriage along the rails 3 will be identical to the vertical position of the tackle-block relative to the rails 3. It is always very useful to know with precision what the exact position of the tackle-block is during all manoeuvres.

To know the position of the carriage one or more guiding marks 70 may be provided on the rails 3. When the carriage 2 is driven into registration with any of these marks 70 the exact vertical height of the tackle-block can be immediately perceived and known whereas with prior art devices, the position of the carriage depends upon the distance of the tackle-block from the rails and it is almost impossible to know the exact position of the tackle-block along an axis parallel to the rails by merely driving the position of the carriage 2 along the rails 3.

This advantage, which is important when the operator is controlling the motion, is even more important when all the operations are done automatically. Thus, if the carriage is automatically raised or lowered to a predetermined postion which might, for example, be determined by limit switches (not shown) disposed along the rails 3 for cooperation with the carriage, the vertical position of the tackle-block would always be known regardless of its lateral position.

Although the device as described hereinabove appears to be the most advantageous for the carrying into effect of the invention, it will be appreciated that various modifications could be made to the invention without exceeding the scope thereof; some of its elements could be replaced by other elements capable of fulfilling the same technical function.

What is claimed is:

1. A guiding and positioning device for the tackle-block of a ship board derrick comprising a pair of spaced parallel guide rails secured to said derrick parallel to and offset from the axis of said derrick, carriage means mounted for movement along said rails, articulated connecting means secured to said carriage means and said tackle-block for permitting displacement of said tackle-block relative to said carriage with a single degree of freedom in a direction perpendicular to said rails without movement of said carriage means and jack means connected perpendicularly at opposite ends to said carriage means and said tackle-block respectively for moving said tackle-block toward and away from said carriage means.

2. A device as set forth in claim 1, wherein said articulated connecting means is comprised of a pair of interconnected link assemblies, each of said assemblies comprising a first pair of link rods pivoted at one end to said tackle block, the opposite end of said first pair of link rods being provided with rollers, guide means mounted on said carriage means for guiding said rollers of said first pair of link rods for movement parallel to said rails, a second pair of link rods pivoted at one end to said carriage means and pivoted at the opposite end at the mid-points of said first pair of link rods, said first link rods being twice as long as said second link rods, and connecting rod means interconnecting the movable ends of the first link rods in one assembly to the movable ends of the first link rods in another assembly for conjoint movement along said means.

3. A device as set forth in claim 2, further comprising latching means for holding said tackle block in extended position away from said carriage means, said latching means comprising a pawl pivoted to said carriage means for movement into and out of the path of movement of at least one of the rollers of the first link rods, spring means normally biasing said pawl into said path and jack means for displacing said panel from said path.

* * * * *